US006016880A

United States Patent [19]

Hall et al.

[11] Patent Number: 6,016,880

[45] Date of Patent: Jan. 25, 2000

[54] ROTATING DRILLING HEAD WITH SPACED APART SEALS

[75] Inventors: Douglas D. Hall; Paul E. Helfer, both of Houston, Tex.

[73] Assignee: ABB Vetco Gray Inc., Houston, Tex.

[21] Appl. No.: 08/942,888

[22] Filed: Oct. 2, 1997

[51] Int. Cl.[7] ..... E21B 33/06

[52] U.S. Cl. ..... 175/195; 166/85.4

[58] Field of Search ..... 175/195, 162, 175/170, 202, 203, 230, 257; 166/85.4, 86.1, 84.2, 84.3, 84.4, 177.3; 277/324, 344, 325, 326

[56] References Cited

U.S. PATENT DOCUMENTS

| | | | |
|---|---|---|---|
| Re. 20,631 | 1/1938 | MacClatchie . | |
| 2,052,939 | 9/1936 | Otis . | |
| 2,554,276 | 5/1951 | Stone . | |
| 2,731,281 | 1/1956 | Knox | 277/326 |
| 2,846,247 | 8/1958 | Davis . | |
| 3,400,938 | 9/1968 | Williams . | |
| 3,492,007 | 1/1970 | Jones . | |
| 3,561,723 | 2/1971 | Cugini . | |
| 3,583,480 | 6/1971 | Regan . | |
| 3,965,987 | 6/1976 | Biffle . | |
| 4,326,584 | 4/1982 | Watkins . | |
| 4,345,735 | 8/1982 | Regan . | |
| 4,358,085 | 11/1982 | Regan et al. . | |
| 4,406,333 | 9/1983 | Adams . | |
| 4,531,591 | 7/1985 | Johnston . | |
| 4,697,639 | 10/1987 | Caraway et al. . | |
| 4,817,724 | 4/1989 | Funderburg, Jr. et al. . | |
| 5,022,472 | 6/1991 | Bailey et al. | 175/195 |
| 5,178,215 | 1/1993 | Yenulis et al. . | |
| 5,213,158 | 5/1993 | Bailey et al. | 166/82 |
| 5,224,557 | 7/1993 | Yenulis et al. . | |
| 5,277,249 | 1/1994 | Yenulis et al. . | |
| 5,279,365 | 1/1994 | Yenulis et al. . | |
| 5,348,107 | 9/1994 | Bailey et al. . | |
| 5,588,491 | 12/1996 | Brugman et al. . | |
| 5,647,444 | 7/1997 | Williams . | |
| 5,662,171 | 9/1997 | Brugman et al. . | |
| 5,662,181 | 9/1997 | Williams et al. . | |

FOREIGN PATENT DOCUMENTS 875914 8/1961 United Kingdom .

OTHER PUBLICATIONS

Kalsi et al., "Development of a higher pressure rotary blowout preventer for safe directional drilling in underbalanced application", Department of Energy Document, pp. 1 and 12, May 1995.

*Primary Examiner*—David Bagnell
*Assistant Examiner*—Sunil Singh
*Attorney, Agent, or Firm*—James E. Bradley; Felsman, Bradley, Vaden, Gunter & Dillon, LLP

[57] ABSTRACT

A drilling head has a body which lands in an external housing. The body is removably secured to the housing with an annular split ring which is moveable in response to a cam member. The body has an outer body and a rotatable inner body with an axial bore. An annulus extends between the inner and outer bodies. Inlet and outlet ports communicate hydraulic fluid to the annulus which is sealed. The inner body has a gripping member with inner and outer portions. The inner portion has a solid annular elastomer which is free to slide radially relative to the inner body. The outer diameter of the inner portion abuts the outer portion. The outer portion has an energizable elastomer with an annular cavity. The cavity communicates with the annulus through a passage. A primary seal extends from a lower end of the inner body. The seal has a conical elastomer and reinforcement webs to give the elastomer greater rigidity in the upward direction. Drill pipe having a plurality of tool joints is lowered through the bore of the drill head. As tool joints are lowered through the primary seal, the elastomer and ribs flex outward. As the tool joints exit the primary seal, it snaps back and seals around the drill pipe. During drilling, the gripping member is energized to grip and provide a secondary seal around the drill pipe, thereby causing the inner body to rotate with the drill pipe.

20 Claims, 3 Drawing Sheets

ROTATING DRILLING HEAD WITH SPACED APART SEALS

TECHNICAL FIELD

This invention relates in general to rotating drilling heads and in particular to a rotating drilling head which seals against drill pipe during drilling.

BACKGROUND ART

A well drilling technique, particularly in highly deviated wells involves using a lightweight drilling fluid or mud. The drilling fluid weight is not heavy enough to prevent upward flow in the well due to formation pressure. A drilling head controls the pressure at the surface.

One type of prior art drilling head utilizes an elastomer to seal against drill pipe while rotating during drilling operations. The seal is an annular member mounted on bearings. It has a smaller inner diameter than the drill pipe, causing it to stretch and frictionally engage the drill pipe. The seal is exposed to abrasive drilling fluids and, thus, wears out quickly. Also, these seals are unable to withstand mud pressure more than a fairly low level.

DISCLOSURE OF INVENTION

A drilling head has a body assembly which lands in an external housing. The housing is mounted below the rig floor. In one embodiment, the body assembly is removably secured to the housing with an annular split ring which is moveable in response to a cam member. The body assembly comprises an outer body and a rotatable inner body with an axial bore. An annulus extends between the outer body and an upper portion of the inner body. Two inlet ports and two outlet ports communicate hydraulic fluid to the annulus, which is sealed on upper and lower sides.

The inner body has a gripping member with an inner portion and an outer portion. The inner portion comprises a solid annular elastomer which is free to slide radially relative to the inner body. The outer diameter of the inner portion abuts the inner diameter of the outer portion. The outer portion comprises an energizable elastomer with an annular cavity. The cavity communicates with the annulus through a passage. Hydraulic fluid pressure in the annulus enters the cavity to energize the elastomer.

A primary seal extends from a lower end of the inner body. The seal has an elastomer with a conical passage and an array of expansible metal ribs or webs adjacent to the elastomer to give it greater rigidity. Drill pipe having a plurality of tool joints is lowered through the bore of the drill head. As tool joints are lowered through the primary seal, the elastomer and ribs flex outward as the tool joints pass through. As the tool joints exit the primary seal, it contracts back to its original shape and seals around the drill pipe. During drilling, the gripping member is energized through the annulus to grip and provide a secondary seal around the drill pipe, thereby causing the inner body to rotate with the drill pipe.

BEST MODE FOR CARRYING OUT THE INVENTION

Figure 1:
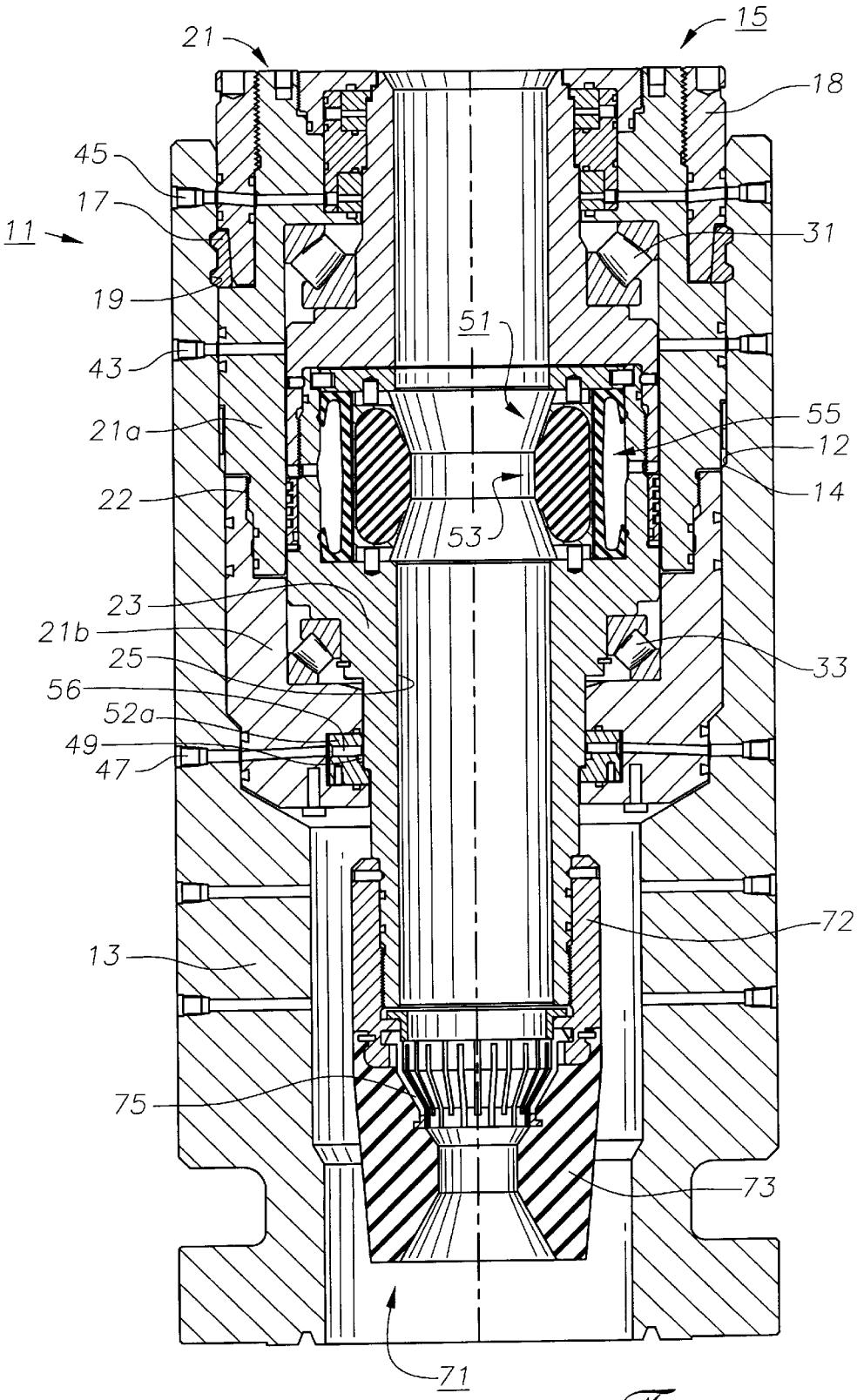
FIG. 1 is a sectional side view of a drilling head constructed in accordance with the invention.

Referring to FIG. 1, a cylindrical drilling head 11 is used in conjunction with drill pipe (not shown) having a plurality of tool joints. The tool joints are the threaded connector portions of each section of pipe and have enlarged outer diameters over the remaining portion of the pipe. Drilling head 11 has a body assembly 15 with a lower shoulder 12 which lands on an upward facing shoulder 14 in an external housing 13. In one embodiment, body assembly 15 is removably secured to housing 13 with an annular split ring or locking member 17. Body assembly may also be secured to housing 13 with a breech lock (not shown). When a cam member 18 is rotated downward relative to body assembly 15, locking member 17 is forced radially outward and seats in a groove 19 in housing 13 to lock body assembly 15 from upward movement.

Body assembly 15 comprises an outer body 21 having an upper portion 21*a* and a lower portion 21*b* which are secured to one another at threads 22. Body assembly 15 also has a rotor or inner body 23 with an axial bore 25. Inner body 23 is rotatable relative to stationary outer body 21 on upper bearings 31 and lower bearings 33. In the preferred embodiment, bearings 31, 33 are tapered spherical roller bearings.

Figure 2:
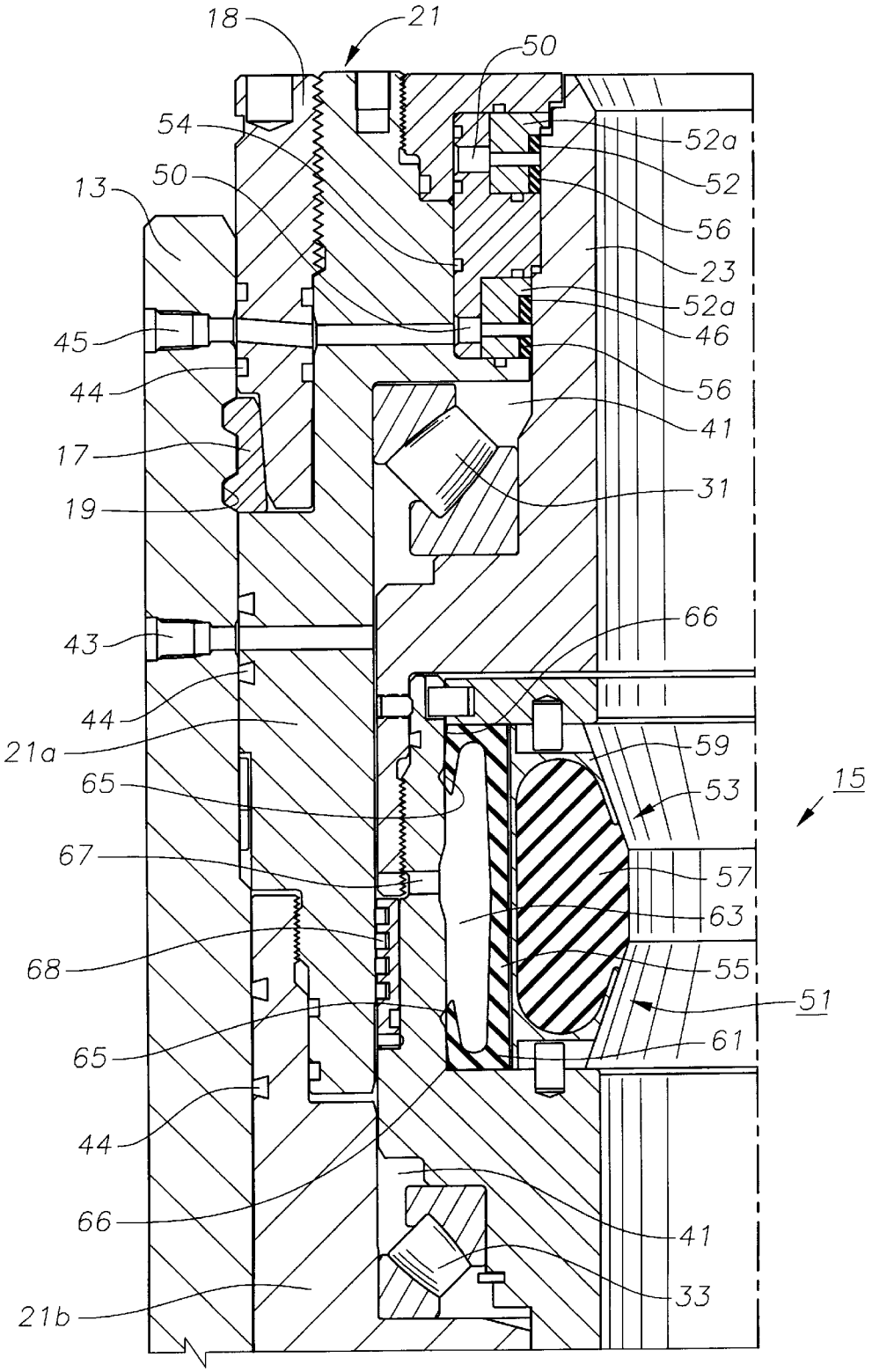
FIG. 2 is an enlarged, left sectional side view of an upper portion of the drilling head of FIG. 1.

As shown in FIG. 2, an annulus 41 extends between outer body 21 and an upper portion of inner body 23. An inlet port 43 and two outlet ports 45, 47 (FIG. 1) communicate hydraulic fluid or lubricant with annulus 41. Seals 44 seal ports 43, 45 between housing 13, cam member 18 and outer body 21. Annulus 41 is sealed on an upper side by seals 46, 52 and on a lower side by seal 49 (FIG. 1). Seals 46, 52 and 49 slidingly engage inner body 23 and are each supported by a seal holder 52*a*. A bronze bushing 56 is located between each seal holder 52*a* and inner body 23. Bushings 56 are provided as sacrificial wear elements to prevent erosion to seals 46, 52 and 49 and seal holders 52*a* as rotor body 23 slides laterally within outer body 21, and to transmit the lateral motion from rotor body 23 to seal holders 52*a*. In the preferred embodiment (not shown), seals 46, 52 and 49 comprise Kalsi seals. Each Kalsi seal 46, 52 handles one half of the hydraulic fluid pressure at the upper end of drilling head 11. Seal 46 reduces the pressure by 50 percent, while seal 52 absorbs the residual pressure to prevent the leakage at the upper end of annulus 41. Seal 46 has a parallel passage 50 that communicates with port 45 for flowing lubricating fluid through the seal. Seals 46, 52 and 49 also have seals 54 for preventing drilling mud from contacting bearings 31, 33.

Inner body 23 has a centrally located packer or gripping member 51 with an inner portion 53 and an outer portion 55. Inner portion 53 comprises a solid annular elastomer 57 which is supported by rigid segments 59. Segments 59 have radially inward facing, C-shaped cross-sections. Inner portion 53 is free to slide radially relative to inner body 23. Elastomer 57 defines the smallest inner diameter of gripping member 51. In an unenergized state, the inner diameter of elastomer 57 is greater than the diameter of the drill pipe but slightly smaller than the diameter of the pipe joints. In an energized state, the inner diameter of elastomer 57 is smaller than the diameter of the drill pipe. The outer diameter of inner portion 53 abuts the inner diameter of outer portion 55. Outer portion 55 comprises a channel or annular elastomer 61 having a radially outward facing, C-shaped cross-section and with an annular cavity 63. Elastomer 61 has a pair of lips 65 which protrude toward one another. Cavity 63 communicates with annulus 41 through a passage 67. Drill head 11 contains an optional labyrinth seal 68 between inner body 23 and outer body upper portion 21*a*. Labyrinth seal 68 is provided for limiting or restricting flow of the lubricant toward lower bearings 33. Because of the close clearance between outer body 21*a* and inner body 23 and/or labyrinth seal 68, the lubricant pressure around lower bearings 33 will be less than that around upper bearings 31. As a result, the lubricant circulating through annulus 41 exerts a downward force on inner body 23 which will partially offset the upward force exerted on inner body 23 by well bore fluid.

Figure 3:
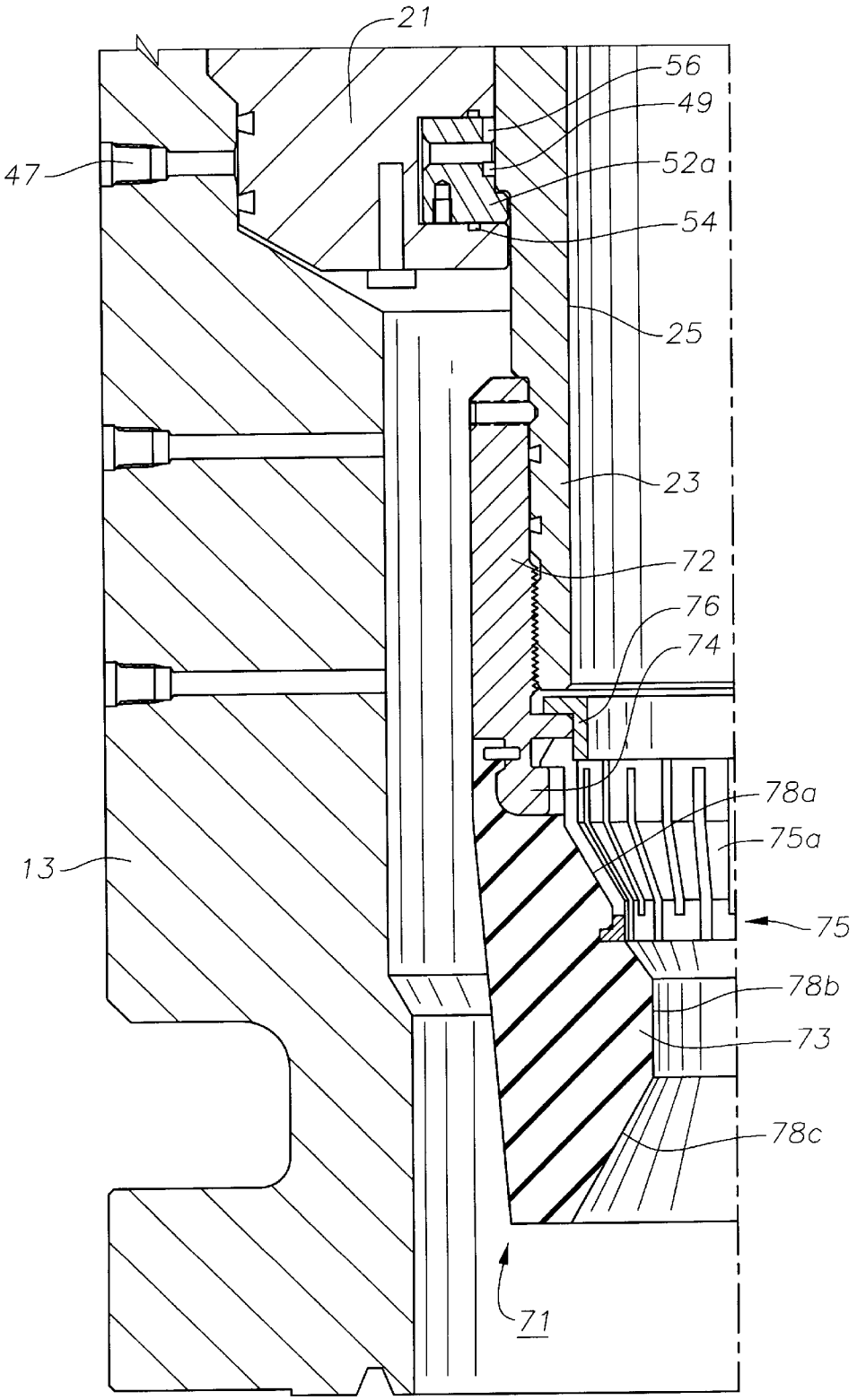
FIG. 3 is an enlarged, left sectional side view of a lower portion of the drilling head of FIG. 1.

Referring now to FIG. 3, a primary seal 71 extends from a lower end of inner body 23 and is spaced axially apart from gripping member 51. Seal 71 has a tubular member 72 which threadingly engages an outer portion of inner body 23. Seal 71 also comprises an elastomer 73 which has a frustoconical exterior and a tapered metal ring 75 along an inner surface. Ring 75 is slit from a lower end. Ring 75 has conically-arrayed reinforcement webs 75*a* which reinforce elastomer 73. The upper end of ring 75 is rigidly fastened to a flange 74 on the lower end of tubular member 72 with a lock ring 76. The lower end of ring 75 mechanically engages an inner portion of elastomer 73. Elastomer 73 is molded around flange 74 and ring 75 to give elastomer 73 greater rigidity against inward-directed forces. The slit in ring 75 allows the individual webs 75*a* to flex radially outward with elastomer 73 in a hinge-like fashion. Elastomer 73 has an axial passage with an upper conical portion 78*a*, a central cylindrical portion 78*b*, and a lower conical portion 78*c*. The internal diameter of central cylindrical portion 78*b* is smaller than the diameter of bore 25, gripping member 51, and the outer diameter of the drill pipe. Seal 71 provides the primary seal for sealing drilling head 11 against the drill pipe. Gripping member 51 causes seal 71 to rotate with the drill pipe and provides an auxiliary or secondary seal for sealing drilling head 11 against the drill pipe.

In operation, a string of drill pipe is lowered through bore 25 of drill head 11 (not shown). Bore 25 is large enough to permit the enlarged diameter of the tool joints to pass through. When tool joints are lowered through seal 71, elastomer 73 and ribs 75 flex radially outward as the tool joint passes through seal 71. As the tool joint exits seal 71, seal 71 contracts back to its original shape with central portion 78*b* sealing around the drill pipe.

During drilling, gripping member 51 is energized to grip and provide a secondary seal around the drill pipe, thereby causing body 23 to rotate with the drill pipe. This is done by pumping hydraulic fluid through inlet port 43. As the hydraulic fluid circulates through annulus 41 and out outlet ports 45, 47, bearings 31, 33, upper seal 46 and lower seal 49 are simultaneously lubricated by the hydraulic fluid. The hydraulic fluid also enters cavity 63 through passage 67. This pressure energizes gripping member 51 by pressing radially inward against outer portion 55 which exerts pressure against inner portion 53. Due to labyrinth seal 68, the pressure in the upper portion of annulus 41 is higher than the pressure in the lower portion of annulus 41. As a result, the upward force applied to inner body 23 by the well fluid pressure is at least partially counteracted by a downward force exerted on inner body 23 by the hydraulic fluid.

Since drilling head 11 will occasionally need maintenance, it is designed to permit body assembly 15 to be easily lifted out of and removed from housing 13 while housing 13 remains mounted below the rig floor. In one embodiment, this operation is performed by unthreading cam member 18 from the upper end of body assembly 15. As cam member 18 recedes, locking member 17 retracts to its original shape and disengages slot 19, thereby releasing body assembly 15 for removal. After maintenance is performed, body assembly 15 can be reinstalled by reversing these steps.

The invention has several advantages. The drilling head combines a gripping member with an axially spaced-apart lower seal to provide increased sealing and gripping support. The rib-reinforced lower seal is more durable and requires less maintenance than prior art designs. The annulus around the gripping member serves the dual role of energizing the gripping member to grip drill pipe and lubricating the bearings. The dual upper seals provide a deliberate pressure "stepdown" in the annulus from bottom to top as lubricant flows. Finally, the body assembly may be easily and quickly removed from the housing to replace worn parts with minimal downtime without requiring rig personnel to enter the cramped and hazardous zone below the rotary opening to perform the latch/unlatch function.

While the invention has been shown in only one of its forms, it should be apparent to those skilled in the art that it is not so limited, but is susceptible to various changes without departing from the scope of the invention.

We claim:

1. A drilling head for use with a drill pipe having a plurality of tool joints, comprising:

an outer body;

an inner body located within the outer body;

at least one bearing located between the inner body and the outer body for facilitating rotation of the inner body relative to the outer body;

a gripper in the inner body for selectively gripping the drill pipe, the gripper being radially moveable between an energized gripping position against the drill pipe and a released position; and a seal mounted to the inner body for sealing around an outer surface of the drill pipe, the seal being axially spaced-apart from the gripper.

2. The drilling head of claim 1 wherein the gripper comprises a hydraulically actuated packer.

3. The drilling head of claim 1 wherein the gripper comprises a hydraulically actuated packer having an energizable outer portion which moves a flexible elastomeric member radially inward relative to the drill pipe.

4. The drilling head of claim 1, further comprising an annulus between the inner body and the outer body, the annulus containing the at least one bearing and having an inlet port and an outlet port for circulating lubricating fluid in the annulus.

5. The drilling head of claim 4, further comprising means for causing a higher lubricant pressure in the annulus at an upper portion of the inner body than at a lower portion of the inner body to create a downward force on the inner body.

6. The drilling head of claim 1 further comprising a housing which receives the outer body; and an annular lockdown member carried by the outer body, the lockdown member locating in a groove provided in the housing for selectively locking the outer body in the housing.

7. The drilling head of claim 1 wherein the at least one bearing comprises upper and lower bearings which are spaced axially apart.

8. A drilling head for use with a drill pipe having a plurality of tool joints, comprising:

an outer body;

an inner body located within the outer body;

at least one bearing located between the inner body and the outer body for facilitating rotation of the inner body relative to the outer body;

a gripper in the inner body for selectively gripping the drill pipe, the gripper being radially moveable between an energized gripping position against the drill pipe and a released position;

a seal mounted to the inner body for sealing around an outer surface of the drill pipe, the seal being axially spaced-apart from the gripper; and wherein the seal comprises a conical array of symmetrically spaced-apart, metal reinforcement elongated members cooperating with an elastomer and extending downward from a lower end of the inner body.

9. The drilling head of claim 8 wherein the elongated members are embedded in the elastomer.

10. A drilling head for use with a drill pipe, comprising:

a housing;

a body assembly mounted within the housing and having an inner body and an outer body;

an annular lockdown member carried between the outer body and the housing for removably locking the body assembly to the housing;

a set of upper and lower bearings located between the inner body and the outer body for facilitating rotation of the inner body relative to the outer body;

a gripper in the inner body for selectively gripping the drill pipe, the gripper being radially moveable between an energized gripping position against the drill pipe and a released position; and a seal carried by the inner body for sealing around an outer surface of the drill pipe, the seal being axially spaced-apart from and below the gripper.

11. The drilling head of claim 10 wherein the gripper comprises a hydraulically actuated packer having an energizable outer portion which moves an elastomeric member radially inward relative to the drill pipe.

12. The drilling head of claim 10, further comprising an annulus between the outer body and the inner body, the annulus containing the bearings and having an inlet port and an outlet port for circulating lubricating fluid in the annulus to energize the gripper and to lubricate the set of bearings; and further comprising:

a restrictive passage in the annulus between upper and lower portions of the inner body for causing the lubricating fluid to create a downward force on the inner body.

13. The drilling head of claim 10 wherein the gripper comprises a hydraulically actuated packer having an energizable outer portion which moves an elastomeric member radially inward relative to the drill pipe; and further comprising an annulus between the inner body and the outer body, the annulus containing the bearings and having an inlet port and an outlet port for circulating fluid in the annulus to energize the gripper and to lubricate the set of bearings.

14. The drilling head of claim 10 wherein the seal comprises an array of symmetrically spaced-apart, metal reinforcement elongated members cooperating with an elastomer and extending downward from a lower end of the inner body.

15. The drilling head of claim 14 wherein the elongated members are embedded in the elastomer.

16. A drilling head for use with a drill pipe connected together by tool joints, comprising:

a housing;

a body assembly mounted within the housing and having an inner body and an outer body;

an annular lockdown member selectively located in a groove in the housing for removably securing the body assembly to the housing;

a set of upper and lower bearings located between the inner body and the outer body for facilitating rotation of the inner body relative to the outer body;

a gripper in the inner body for selectively gripping the drill pipe, the gripper being radially moveable between an energized gripping position against the drill pipe in response to fluid pressure and a released position;

an annulus between the inner body and the outer body, the annulus containing the bearings and having an inlet port and an outlet port for circulating fluid in the annulus to provide fluid pressure to energize the gripper and to lubricate the set of bearings; and a seal in the body assembly for sealing around an outer surface of the drill pipe, the seal being axially spaced-apart from and below the gripper and outwardly flexible for allowing the tool joints to move through the seal when the drill pipe is moved axially.

17. The drilling head of claim 16, further comprising:

a passage for communicating fluid between the annulus and the gripper; and wherein the gripper comprises a hydraulically actuated packer having a fluid energizable outer portion which moves a flexible elastomeric member relative to the drill pipe.

18. The drilling head of claim 16 wherein the seal comprises an elastomer and an array of symmetrically spaced-apart, metal reinforcement elongated members cooperating with the elastomer and extending downward from a lower end of the inner body.

19. The drilling head of claim 18 wherein the elongated members are embedded in the elastomer.

20. The drilling head of claim 16, further comprising a restrictive passage in the annulus for causing the fluid to create a downward force on the inner body.

* * * * *